United States Patent [19]

Hull

[11] 4,321,808

[45] Mar. 30, 1982

[54] APPARATUS FOR TREATMENT OF YARN IN PACKAGE FORM

[75] Inventor: Donald R. Hull, Wilmington, Del.

[73] Assignee: Glen Head Inc., Canton, Ga.

[21] Appl. No.: 140,896

[22] Filed: Apr. 16, 1980

[51] Int. Cl.[3] ..... D06B 5/18; D06B 23/04

[52] U.S. Cl. ..... 68/43; 68/194; 68/198

[58] Field of Search ..... 68/5 C, 5 E, 7, 8, 43, 68/147, 181 R, 184, 186, 187, 189, 194, 198, 200, 205 R; 8/150, 154, 155, 155.1, 155.2

[56] References Cited

U.S. PATENT DOCUMENTS

| | | | |
|---|---|---|---|
| 715,719 | 12/1902 | Willard | 68/187 |
| 723,795 | 3/1903 | Willard | 68/187 |
| 1,052,817 | 2/1913 | Hebden et al. | 68/189 |
| 1,604,560 | 10/1926 | Johnston et al. . | |
| 1,607,928 | 11/1926 | Van Ness . | |
| 1,724,015 | 8/1929 | Gere . | |
| 1,759,144 | 5/1930 | Van Ness . | |
| 1,759,157 | 5/1930 | Gere . | |
| 1,779,831 | 10/1930 | Stokes | 8/155 X |
| 1,841,024 | 1/1932 | Garey et al. | 68/189 X |
| 1,915,779 | 6/1933 | Gere . | |
| 2,058,576 | 10/1936 | Dulken | 8/155 |
| 2,174,178 | 9/1939 | Nichols . | |
| 3,120,422 | 2/1964 | Weir . | |
| 3,145,398 | 8/1964 | Wyatt | 8/155.1 |
| 3,547,575 | 12/1970 | Theodores | 8/149.1 |
| 3,700,402 | 10/1972 | Nevda et al. . | |
| 3,743,477 | 7/1973 | Egli et al. . | |
| 3,787,176 | 1/1974 | Von der Eltz et al. . | |
| 3,878,575 | 4/1975 | Wedler | 8/155.1 |
| 3,960,487 | 6/1976 | Stritzko | 8/155.1 |
| 3,964,278 | 6/1976 | Korsch et al. | 68/5 E |
| 4,097,232 | 6/1978 | Negola et al. | 8/155.1 X |
| 4,150,448 | 4/1979 | Plack | 8/150 |
| 4,165,623 | 8/1979 | Negola et al. | 68/194 X |

FOREIGN PATENT DOCUMENTS

| | | | |
|---|---|---|---|
| 693409 | 7/1940 | Fed. Rep. of Germany . | |
| 2026647 | 6/1970 | Fed. Rep. of Germany . | |
| 1600225 | 7/1970 | France . | |
| 2044233 | 2/1971 | France . | |
| 2904 | of 1858 | United Kingdom | 68/187 |
| 359232 | 11/1931 | United Kingdom . | |
| 1149355 | 4/1969 | United Kingdom . | |

*Primary Examiner*—Philip R. Coe

*Attorney, Agent, or Firm*—Mandeville and Schweitzer

[57] ABSTRACT

A method and apparatus for dyeing of yarn in package yarn form wherein a yarn package of a given initial density is compressed axially to a second density and thereafter a metered quantity of a yarn treating agent is introduced into selected portions of the package followed by a diffusing fluid introduced into the said selected portions to diffuse the yarn treating agent into selected portions of the package.

6 Claims, 4 Drawing Figures

APPARATUS FOR TREATMENT OF YARN IN PACKAGE FORM

TECHNICAL FIELD

The present invention relates generally to the treatment of yarn in package form.

BACKGROUND OF THE INVENTION

In general, the pleasing color effects which can be obtained in a fabric through the use of what is commonly referred to as "space dyeing" have been recognized in the art. It is also often desirable to dye yarn used in making textile materials to a uniform color. Furthermore, methods and apparatus have been developed over the years to achieve such effects by selectively dyeing portions of a yarn package. As used herein, the term "yarn in package form" or "yarn package" is intended to denote and mean a mass of yarn which has been wound on a core such as a tube, cone, pern dye spring or other such conventional holders and would include also such yarn packages from which the core has been removed. Space dyeing methods fall into two broad categories. One of these categories involves the use of needles to inject dye into selective portions of the yarn package. Typical of this type of treatment is the process disclosed in U.S. Pat. No. 3,547,575. Such prior art methods are time consuming and present problems with reproductibility and uniformity of dyeing. Furthermore, when using fine denier yarns, the needles usually tear the yarn fibers causing obvious problems when the yarn is subsequently fashioned into a fabric by weaving or knitting.

The second broad category of prior art processes is typified by U.S. Pat. No. 3,145,398 in which dye is forced radially through selective portions of a yarn package through the use of centrifugal force. The centrifugal force method exhibits the inherent disadvantage of distorting the yarn package during the process.

It is noted in passing that pressure per se has been used in the prior art for dyeing yarn in package form. However, in such prior art processes, as disclosed for example in U.S. Pat. Nos. 3,878,575 and 1,841,024 the entire package was uniformly dyed to the same shade or color.

Although it is sometimes desirable to uniformly dye a yarn package, these prior art dyeing processes usually involve waste of dye material and energy, which often results in waste treatment and pollution problems. Recirculation of the dye through the yarn package in order to produce a uniform color, as used for example in German Pat. No. 693,409, of necessity is restricted to a single process which produces a single dye effect in the end product. Furthermore, such processes frequently require long periods of time in the order of an hour or more to completely dye a yarn package.

Space dyeing has also been accomplished through the use of resists which alter dye sites in the yarn to cause them to be unreceptive to certain kinds of dyes. See, for example, U.S. Pat. No. 3,743,477 which discloses certain fiber-reactive compounds which may be applied to specified fibers to provide local reservation against dyeing with anionic or acid dyes. See also the application of resists by roller printing to form a pattern of resist and non-resist sections as disclosed in U.S. Pat. No. 3,700,402. However, roller printing fine denier yarns is both impractical and commercially unattractive because of the high cost.

Each of the prior art methods of achieving a varigated dye effect on yarn has one or more undesirable characteristics which has heretofore limited the commercial acceptance of these methods. The need for a new technique which provides the desired pleasing multi-colored or ombre effect, and also provides the capability of uniform dyeing, without undesirable features, is evident. The invention herein is an improvement of the apparatus and method disclosed in U.S. Pat. Nos. 4,165,623 and 4,097,232.

SUMMARY OF THE INVENTION

The present invention is predicated, in part, on the discovery that a yarn treating agent can be selectively and reproducibly diffused into a mass of yarn in package form by first compressing the package axially to a predetermined density, introducing a prescribed (metered) quantity of the yarn treating agent into the compressed package and then diffusing the yarn treating agent into the package by means of a diffusing fluid under pressure. The diffusing fluid under pressure causes the yarn treating agent to selectively penetrate the package and to coat the individual strands of yarn or fibers and, if desired, to fully penetrate the package. The quantity of yarn treating agent introduced is optimally only that amount which is retained within the package. This unique and unobvious solution to the long-standing problem in the yarn dyeing field provides a simple, practical and commercially attractive method of obtaining the objectives of dyeing without any of the drawbacks of the prior art processes.

The apparatus of the present invention involves taking a yarn package having a predetermined initial density in respect of the individual strands of yarn in relation to each other, compressing the yarn package to a predetermined second density, infusing a prescribed quantity of yarn treating agent, e.g., a dye acceptance modifier, a dye, or the like, into at least one end of a yarn package, and applying a diffusing fluid to at least one end of the compressed yarn package which was infused with the treating fluid to diffuse the treating fluid through the compressed yarn package. The diffusing fluid (which may be air) passes through the compressed yarn package and carries with it the yarn treating agent. In this manner controlled penetration of the yarn treating agent is obtained. The process can also include the step of infusion of the yarn package with a heated fluid, such as steam, following the diffusion step to cause reaction between the yarn treating agent and the yarn.

Taking, for example, the method in which a dye is infused or introduced at only one end of the package, the result of these process steps can provide a yarn package having different sections which contain varying amounts of dye. In the section contiguous to the end at which the dye was infused, there is a relatively large concentration of dye. In the section contiguous to the opposite end of the yarn package there is little or virtually no dye present. In the middle section there ia a concentration or proportion of dye which is intermediate that of the two end sections. It can be seen that as the yarn is unwound from the package so treated, there will be repeating sequences of contiguous lengths of yarn which are fully treated, intermediately treated, and untreated by the dye.

It is also possible in the practice of the present invention to uniformly dye the entire yarn package to a desired color or series of colors.

In a preferred embodiment of the present invention, a yarn package may be treated with one or more dyes thereby producing yarn which has contiguous sections of differently colored lengths. For example, if a first dye is introduced at one end of the package, and a different color dye is introduced at the other end of the package, yarn having lengths of the two colors in addition to a blend of the two colors will be produced. Moreover, by a manner discussed in detail hereinbelow, it is possible to introduce two or more dyes at each end of the package thereby providing a dyed yarn which has contiguous lengths of at least four colors and additional lengths of blends of the colors or dyes used. It is also possible to eliminate the blending of the colors to produce contiguous lengths of a plurality of different colors. When desired, a totally random pattern of colored lengths of yarn can be produced. Therefore, the present invention provides complete control over the color effects of the end product through the use of a single process.

As used herein the term "end" of a package of yarn is intended to denote a face of the yarn package which is perpendicular to the longitudinal axis of the wound yarn. Using this terminology, a yarn package has two ends and a circumferential surface, the latter being cylindrical or conical in shape, for example, depending upon the method of winding employed. As used herein, the term "yarn in package form" or "yarn package" is intended to denote and mean a mass of yarn which has been wound on a core such as a tube, cone, pern, dyespring, or other such conventional holders and would include also such yarn packages from which the core has been removed. As used herein, the terms "fiber" and "yarn" have the same meaning as those normally used in the art, i.e., "fiber" means an individual filament of natural or synthetic material and the term "yarn" means a bundle of several fibers gathered together and normally twisted together.

An inherent advantage of the present invention is that it makes possible the rapid treatment of a large mass of yarn in compact form, i.e., in the form of a package of yarn rather than in skein, warp, or knitted sock form. A typical yarn package may be dyed in one minute or less, whereas prior art techniques may require an hour or more. The particular type of package employed in the present invention is not critical. Thus, the yarn may be wound on a cone, tube, or pern, or wound to form a package in any similar manner. Of course, the repeat pattern of the treated yarn will vary in accordance with the method used to wind the yarn. For example, if the yarn is wound with constant speed and constant traverse, i.e., drum wound, and the package is treated from the ends, the repeat sections of the yarn which are fully treated, partially treated and untreated will be of the same proportional lengths throughout the entire mass of yarn in the package. This gives the most desirable effect and distribution of dyestuffs.

By the embodiment of the method briefly outlined above using a dye, a package of yarn is obtained in accordance with the present invention which has the characteristics of a space dyed yarn package.

Direct dyeing of the package using another embodiment of the method in which one or more dyes are infused into different surfaces also offers many advantages. Color effects not otherwise obtainable are accomplished in a simple manner with maximum utilization of dye and minimum expenditure of energy.

It has further been discovered that the method of the present invention is reproducible in the sense that if the same amount of yarn treating agent is used followed by a uniform, non-varying, treatment of compression, infusion and diffusion with a fluid under pressure, the repeat sequences are substantially the same. Where more than one dye is used in accordance with the present invention, then the repeat sequences of the colors in the yarn packages are also reproducible.

In addition to the foregoing, yarn in package form may be treated with other agents such as yarn lubricants, soil retarding agents, flame retarding agents, fungacides and the like in order to create certain desired effects. In essence, the method of the present invention is useful in permeating a yarn package with any conventional or known yarn treating agent in a predetermined manner. Another advantage of the present invention is the ability to treat a yarn package without the application of heat. Apart from the saving of energy, the treatment without heat permits uniform distribution of the treating agent throughout the yarn package resulting in, for example, uniform dyeing of the yarn package. It also permits dyeing of fibers which are undesirably effected by heat, such as nylon, rayon, wool, and cotton, without the undesirable effects.

Accordingly, it is an object of the present invention to provide an improved apparatus for treating yarn in package form.

Another object of the present invention is to provide a method of treating yarn which does not require the application of heat in any form, thereby making the apparatus more energy efficient.

A further object of the present invention is to provide a apparatus for treating yarn which is subject to shrinkage or modification by heat such that said yarn can be treated without shrinkage or modification.

These and other objects, features and advantages of the present invention will become apparent from a reveiw of the following detailed description of particular embodiments and the appended drawings and claims.

DESCRIPTION OF A PARTICULAR EMBODIMENT

Figure 4:
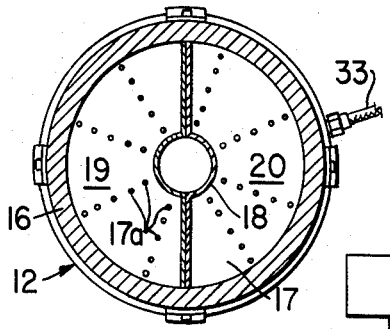
FIG. 4 is a cross section taken in the direction of arrows 4—4 of FIG. 1.
Figure 1:
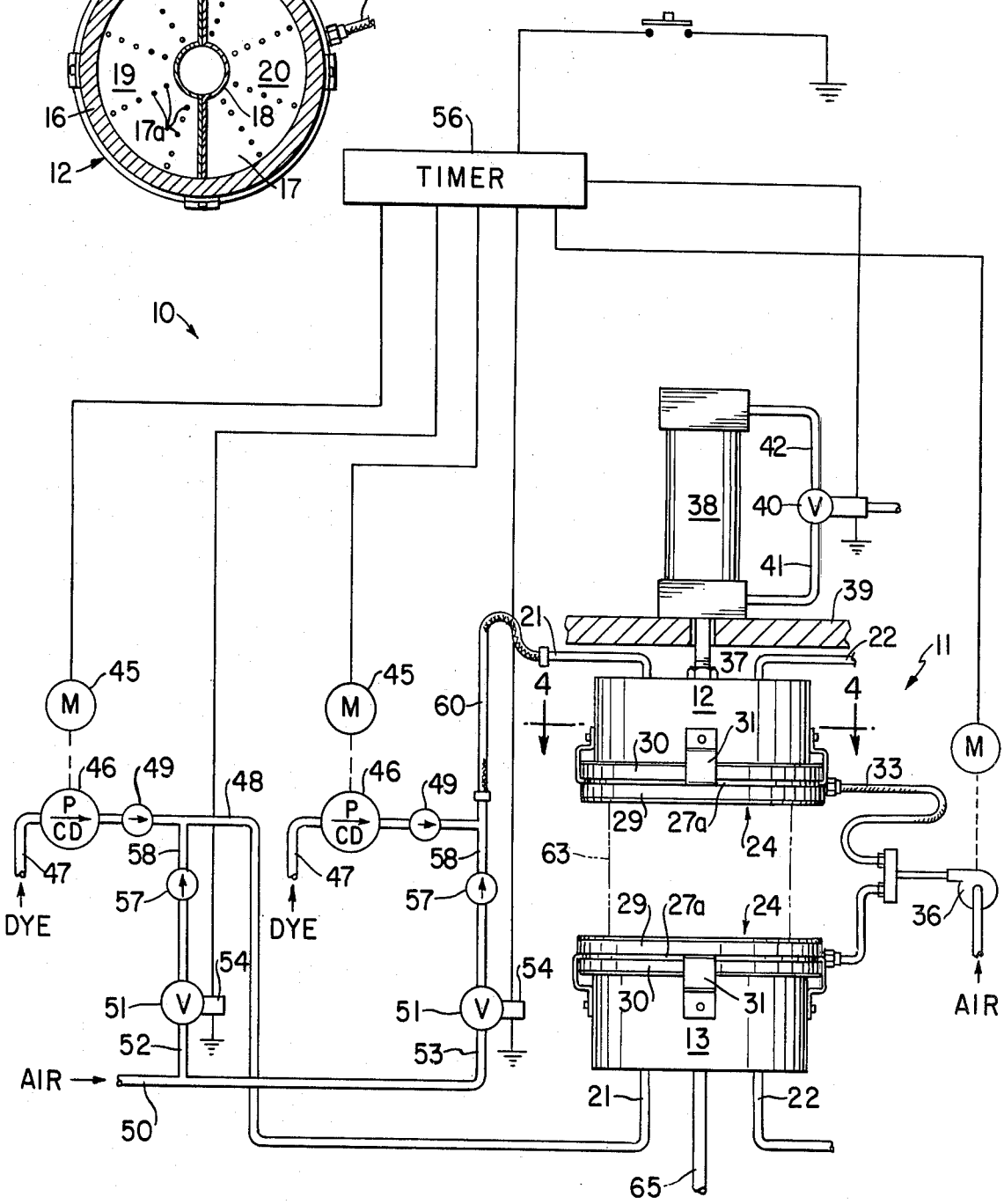
FIG. 1 is a schematic illustration of the apparatus made in accordance with the present invention for carrying out the method of the present invention.
Figure 2:
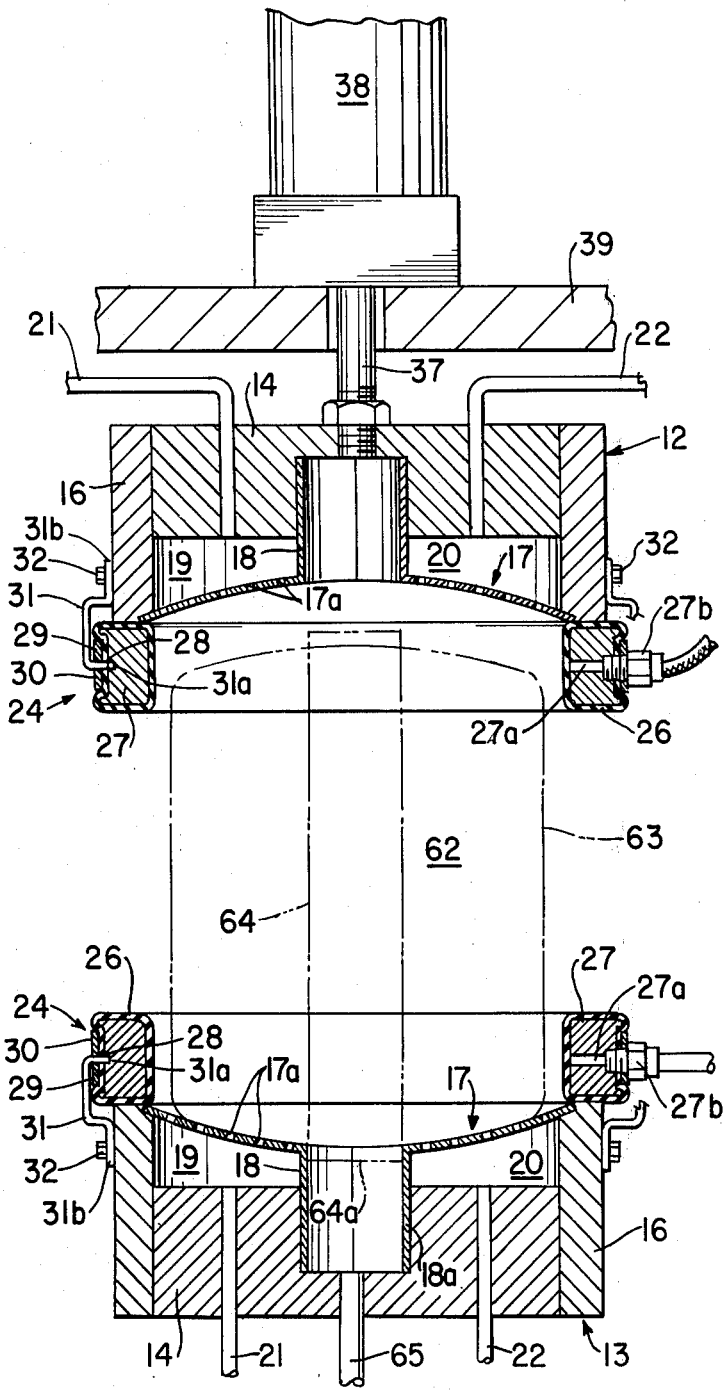
FIG. 2 is an enlarged view generally in cross section of the yarn package receiving portion of the apparatus of FIG. 1 with the yarn package enclosing portions thereof in the open position.
Figure 3:
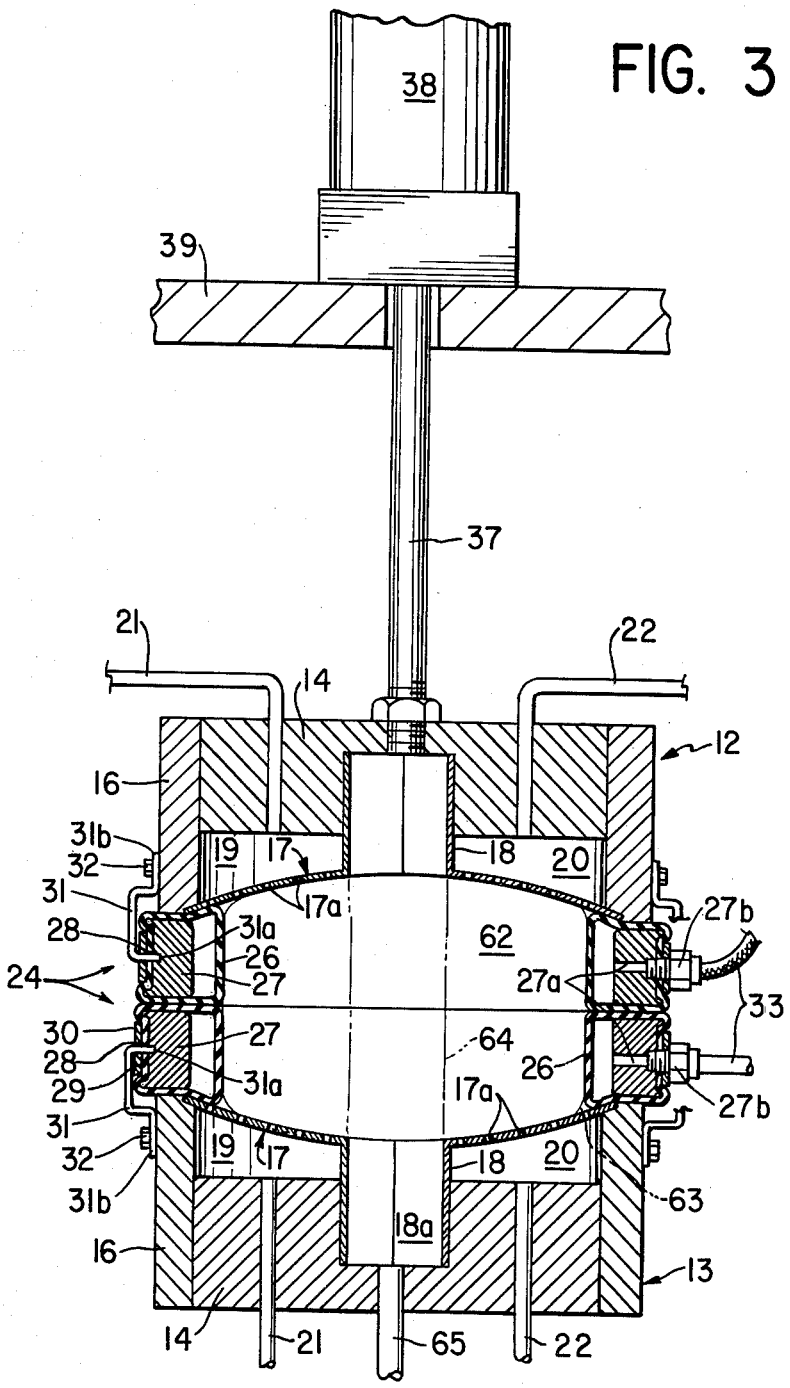
FIG. 3 is a cross sectional view showing the apparatus of FIG. 2 in its closed position.

Referring now to the drawing and initially to FIGS. 1–3 thereof, an apparatus 10 constructed in accordance with the present invention and capable of performing the method of the invention has been illustrated. Apparatus 10 includes yarn package receiving and dyeing means 11 which includes an upper vertically movable header 12 and a stationary lower header 13. Headers 12 and 13 are essentially identical and corresponding parts have therefore been given the same reference numerals. Accordingly, each header consists of a circular end plate 14 and a cylindrical side wall 16 which is joined thereto by welding or other appropriate means. The opposite ends of side wall 16 are attached to a curved foraminous plate 17 which defines therein a plurality of foramina 17*a*. Each plate 17 is connected to an axially aligned cylindrical member 18 which is joined to the foraminous plate 17 and to the circular end plate 14. The member 18, together with the end plate 14 and side wall 16, thus define two chambers 19 and 20. A yarn agent conduit 21 communicates with the interior of chamber 19 and a second conduit 22 communicates with chamber 20.

Extending from the inner facing ends of side walls 16 of the respective headers 12 and 13 are assemblies 24, each of which includes an inflatable skirt 26 surrounding an inner rigid core member 27. The skirt 26 is wrapped around the core member 27 and the ends of the skirt abut at 28. Two circular clamps 29 and 30 seal the ends of the skirt 26 against the outer periphery of the core 27. Each assembly 24 is attached to its respective header 12, 13 by a series of peripherally positioned brackets 31, one end 31*a* being wedged in a circumferential recess 27*a* in the core member 27, and the other end 31*b* being held tightly against the surface 23 of headers 12 and 13 by bolts 32. The core member 27 is provided with a radial passage 27*a* which is connected by fitting 27*b* to hose 33 which is in turn connected to the manifold 34 (FIG. 1) and air pump 36.

Circular plate 14 of header 12 is threadably connected to a rod 37 which is the actuating rod of air actuator 38. The latter is mounted upon frame member 39 and contains a piston (not shown) which may be reciprocally moved in opposite directions by the admission of air through valve 40 in lines 41, 42 into opposite ends of the actuator. Accordingly, air admitted by valve 40 through line 41 to the upper end of actuator 38 will drive the header 12 downwardly toward fixed header 13.

Referring to FIG. 1, the apparatus of the present invention includes means for metering yarn treating agents such as dyes into the headers 12 and 13 and means for subsequently directing air into the headers to cause diffusion of the yarn treating agent into a yarn package as will be more specifically described. Two identical separate systems for metering a yarn treating agent and for air diffusion have been shown in FIG. 1, and for simplicity, the various parts thereof will be given the same reference numerals. Each metering system includes a motor 45 which drives a metering pump 46 whose input conduit 47 admits yarn treating agent (e.g. dye) to the pump. The outlet of pump 46 is connected to conduit 48 which includes a check valve 49 permitting flow only in the direction of the arrow. Conduit 48 carries dye to conduit 21 which supplies chamber 19 in the lower header 13. Air under pressure may be admitted to conduit 50 and may not proceed farther if the valves 51 are set to check the flow of air respectively in conduits 52 and 53. Valves 51 are operated by solenoids 54 which are under the control of timer 56. When valves 51 are opened, check valves 57 permit the flow of air through conduit 58, and since check valves 49 will block the flow of air toward pump 46, air may only flow through conduits 48 and 60, into conduits 21 respectively, and into chambers 19 in upper and lower headers 12 and 13. It will be understood that identical systems (not shown) will admit dye and air into conduits 22 and thus into chambers 20 in headers 12 and 13.

Referring again to FIGS. 2 and 3, headers 12 and 13 define therebetween a yarn treating chamber 62 in which a cylindrical yarn package 63 may be placed. FIG. 2 illustrates the chamber in its open (yarn package receiving/discharging) position and FIG. 3 in the closed (yarn package treating) position. The yarn package 63 consists of many turnings of yarn helically wound on a spool 64, the lower end 64*a* which will initially be placed within a chamber 18*a* defined by lower cylindrical member 18. An axial drain 65 connects the interior of chamber 18*a* and the exterior of header 13. FIG. 3 illustrates the position of the headers 12 and 13 when the upper header 12 has been thrust downwardly by the actuator 38. In this position it will be seen that the yarn package 63 has been axially compressed to approximately 50% of its initial length and that the members 18 (upper and lower) provide means for the core 64 to be accommodated during such compression. The degree or amount of compression of a yarn package is related to its initial density. If a package is very dense, less compression will subsequently be required to obtain satisfactory diffusion of the yarn treating agent.

FIG. 3 illustrates that when the yarn package 63 has been compressed, air will be admitted from pump 36 through lines 33 and into the inflatable skirts 26, which when they are inflated exert a radial sealing force against the sides of the package 63. The purpose of the inflatable skirt 26 is to seal in the yarn treating agent or dye as it is diffused throughout the package, and the skirt has the capacity to accommodate different diameters of package while achieving this effect. The curved foraminous plate 17 actually causes the axial compression of the package, the plates being concave to match the convex end contours of the yarn package. Therefore, all axial forces will be essentially evenly distributed throughout the radial cross section of the yarn package. This will promote greater uniformity in diffusion of the yarn treating agent or dye throughout the package. To enhance diffusion along and toward the axial center of the package, the core 64 can be perforated to permit egress of diffusing fluid through the core therefrom through drain 65. Where conically shaped yarn packages are to be treated, it may be desirable to vary the shape or size of plates 17 to match the ends of the package.

It will be understood that as an aspect of the present invention, the yarn package 63 should have a known initial (uncompressed) density upon the core. It is important that yarn packages of a given production run have a fairly uniform density so that the same axial compression can be used for all such yarn packages of a production run. In order to achieve such unformity it may be necessary to rewind the yarn packages to a predetermined initial density. A typical yarn package used in the machine of the invention for example, weighs $2\frac{1}{2}$ pounds (1135 grams) and is wound on a perforated plastic tube 1 13/16 inches (4.6 centimeters) in diameter and $6\frac{3}{4}$ inches (77.1 centimeters) long. The yarn package measures $7\frac{3}{4}$ inches (19.7 centimeters) in diameter by $5\frac{1}{4}$ inches (13.3 centimeters) long at the perimeter and $5\frac{3}{4}$ inches (14.6 centimeters) long at the core. Its shape is that of a cylinder with conical ends. Volume is about 240 cubic inches (3931 centimeters). As placed in the machine, yarn package density is about 0.0104 pounds per cubic inch (0.288 grams per cc). The package is compressed, prior to treating, between the heads of the machine to about 71.5% of its original height (measured at the outside of the package). This causes the yarn package density to increase about 40% to about 0.0146 pounds per cubic inch (0.404 grams per cc). This higher density improves wicking of the yarn treating within the yarn volume without seriously impeding flow of that agent from the metering pump through the foraminous plate or plates into the yarn package.

It should also be mentioned that although in the embodiment of FIGS. 1–3, the yarn chamber has been shown in a completely closed position during the yarn treating stage, it is not absolutely necessary for the chamber to be totally closed. Even when the chamber 62 is fully closed, air can escape from the space between the opposing skirts 26 during the diffusion of yarn treating agent or dye into the package.

The operation of the above system will now be described. Referring to FIG. 1, timer 56 controls the sequence of operation of the system which may be initiated by depressing start button 68. Prior to such initiation, a yarn package 63 of prescribed initial density will be placed into open chamber 62. Timer 56 will initiate actuator 38 to move header 12 downwardly to the position of FIG. 3 and in so doing, the yarn package will be compressed axially to a second prescribed density. Skirt 26 will then be inflated. Metering pumps 46 will next cause a measured quantity of yarn treating agent such as a dye to flow into the respective sets of chambers 18 and 19. The amount of such agent is metered and where total dyeing of a yarn package is contemplated, the amount metered should be equal to or only slightly greater than the amount which is to be retained in the package. Excess amount, if any, will flow from chamber 62 through drain 65. It has been found that where selected portions of a package are to remain untreated, such portions should be diffused (using the method and apparatus of the invention) with a neutral fluid, for example, water which acts to prevent the diffusion of the yarn treating agent into the portions selected for non-treatment.

In the disclosed embodiment, it is possible to admit different yarn treating agents or a neutral fluid into respective ones of chambers 18 and 19 to achieve different effects as will be understood by those skilled in the art. It will further be understood that the same yarn treating agent may be admitted into each chamber 18, 19 for dyeing a yarn package in a solid color.

After a prescribed amount of yarn treating agent is introduced into chambers 18 and 19 and into the package, the timer 56 will initiate appropriate closure of valves 51 and opening of valves 54 to admit a diffusing fluid (air) into the chamber 18, 19 and into the yarn package. The diffusing fluid will carry the yarn treating agent throughout the yarn package, and the air, which is initially trapped in the package will be displaced as the yarn treating agent is propagated into the sections to be treated. Such displaced air and air or other fluid which is used to diffuse may flow from the chamber 62 between the abutting ends of skirts 26, and where the core 64 is perforated, through the center of the core and through drain 65. The foregoing process takes about one minute, which is considerably shorter than the amount of time required for prior package yarn dyeing methods which may take one hour or more. Furthermore, optimally only the amount of yarn treating agent or dye is introduced into the package which the yarn package is capable of retaining. In some instances, in order to assure complete coverage throughout the package a slightly greater amount of yarn treating agent may be used, but in any case, the amount required is much less than used in prior yarn package systems and greatly reduces pollution and energy problems.

It will be understood that the foregoing description has been of a particular embodiment of the present invention and is therefore representative. In order to understand fully the scope of the present invention, reference should be made to the appended claims.

I claim:

1. In an apparatus for treating a yarn package with a yarn treating agent, said package consisting of multiple strands of yarn wound laterally upon a core into the form of a body of rotation, having radially extending ends and generally axially extending sides, comprising means for encapsulating end portions of said package, means in said encapsulating means to contact said package uniformly across the opposite ends of said package, said contacting means defining openings for admission of fluid into said package, means for moving at least part of said encapsulating means axially toward the center of said package to compress the package to a predetermined density, means for introducing a measured quantity of a yarn treating agent under pressure into said encapsulating means and through preselected ones of said openings into said package and means for introducing a diffusing fluid into said preselected openings to further diffuse said yarn treating agent throughout at least portions of said packge, the improvement comprising (a) an inflatable annular skirt, mounted for cooperation with said encapsulating means, (b) said skirt, when inflated, expanding radially inward to conform to the sides of said yarn package whereby radial sealing pressure about the sides inhibits egress of said yarn treating agent from the sides of said package.

2. The apparatus according to claim 1, wherein said inflatable skirt is inflatable by a variable amount within a predetermined range, whereby the radial sealing pressure is variable.

3. In an apparatus for treating a yarn package with a yarn treating agent, said package consisting of multiple strands of yarn wound laterally upon a core to form radially extending ends and generally cylindrical sides comprising means for encapsulating end portions of said package, means in said encapsulating means to contact said package uniformly across the opposite ends of said package, said contacting means defining openings for admission of fluid into said package, means for moving at least part of said encapsulating means axially toward the center of said package to compress the package to a predetermined density, means for introducing a measured quantity of a yarn treating agent under pressure into said encapsulating means and through preselected ones of said openings into said package and means for introducing a diffusing fluid into said preselected openings to further diffuse said yarn treating agent throughout at least portions of said package, means in cooperation with said encapsulating means for exerting radial sealing pressure about the sides of said yarn package to inhibit egress of said yarn treating agent from the sides of said package, wherein said encapsulating means includes oppositely facing headers each having cylindrical walls defining recesses therein for the reception of end portions of said yarn package, at least one of said headers being movable toward the other, opposing end portions of said cylindrical walls being supportably connected to a circular core of relatively rigid material, said means for exerting radial sealing pressure including an inflatable skirt wrapped around said core to have opposite ends thereof lie adjacent to each other about the exterior periphery of said core, clamping means for securing the adjacent ends of said skirt in sealing relationship with respect to said core and means internally of said core and said skirt for introducing a fluid to the radially interior periphery of said skirt to effect expansion of said skirt in a radial direction against the sides of a yarn package.

4. The apparatus according to claim 3 wherein the fluid to effect expansion is air.

5. The apparatus according to claim 3 wherein said core defines a radially exterior circumferential groove between the adjacent ends of said skirt, a plurality of brackets for mounting said skirt and core to each header, one end of each of said brackets being secured within said groove, the other end being attached to said header.

6. The apparatus according to claim 1, wherein a further improvement comprises having the means to contact the ends of said yarn package uniformly be in the form of a concave foraminous plate, the contour of which closely matches the contours of the ends of said yarn package whereby said concave foraminous plates exert uniform axial pressure upon said yarn package during compression thereof.

* * * * *